US008505124B2

(12) United States Patent
Eichler et al.

(10) Patent No.: US 8,505,124 B2
(45) Date of Patent: Aug. 13, 2013

(54) OFF-SET CARRIER

(75) Inventors: Ben Eichler, Erie, PA (US); Frank Schaetzke, Pipersville, PA (US); Douglas R. Wroblewski, Erie, PA (US)

(73) Assignee: Zurn Industries, LLC, Erie, PA (US)

( * ) Notice: Subject to any disclaimer, the term of this patent is extended or adjusted under 35 U.S.C. 154(b) by 721 days.

(21) Appl. No.: 12/261,482

(22) Filed: Oct. 30, 2008

(65) Prior Publication Data

US 2009/0249535 A1 Oct. 8, 2009

Related U.S. Application Data

(60) Provisional application No. 61/042,092, filed on Apr. 3, 2008.

(51) Int. Cl.
*E03D 11/00* (2006.01)
*E03D 11/14* (2006.01)

(52) U.S. Cl.
USPC ..... 4/252.2; 4/252.1; 4/252.4

(58) Field of Classification Search
USPC ..... 4/252.1–252.6
See application file for complete search history.

(56) References Cited

U.S. PATENT DOCUMENTS

| | | | | |
|---|---|---|---|---|
| 2,015,349 | A | | 9/1935 | McArthur |
| 2,055,489 | A | | 9/1936 | Groeniger |
| 2,055,490 | A | | 9/1936 | Groeniger |
| 2,393,581 | A | | 1/1946 | Wentworth |
| 2,845,631 | A | | 8/1958 | Kozlowski et al. |
| 2,899,690 | A | | 8/1959 | Clifford |
| 3,015,501 | A | | 1/1962 | Minella |
| D195,243 | S | | 5/1963 | Kelly |
| 3,271,054 | A | * | 9/1966 | Schmid ..... 285/93 |
| 3,826,539 | A | * | 7/1974 | Kunz et al. ..... 406/182 |
| 3,855,649 | A | | 12/1974 | Morris et al. |
| 3,967,836 | A | | 7/1976 | Izzi, Sr. |
| 4,058,859 | A | | 11/1977 | Arrowood |
| 4,544,188 | A | * | 10/1985 | Dugger ..... 285/337 |
| D284,887 | S | | 7/1986 | Milo |
| 5,819,326 | A | | 10/1998 | Kobayashi et al. |
| 6,052,839 | A | | 4/2000 | Teskey |
| 6,101,774 | A | | 8/2000 | Heil |
| 6,155,606 | A | | 12/2000 | Phillips |
| 6,349,975 | B1 | | 2/2002 | Heil |
| 6,435,563 | B2 | | 8/2002 | Phillips |

(Continued)

OTHER PUBLICATIONS

Zurn Z-1203-H Specification Sheet, dated Aug. 9, 1994, 1 page.

*Primary Examiner* — William Gilbert
*Assistant Examiner* — Patrick Maestri
(74) *Attorney, Agent, or Firm* — The Webb Law Firm

(57) ABSTRACT

An off-set pipe coupling for use in a support system for a wall mounted toilet or water closet includes a curved pipe having a first end and a second end; a first plate coupled to the first end of the curved pipe; and a second plate coupled to the second end of the curved pipe. The first plate has a central hole in fluid communication with the curved pipe and a plurality of screw holes positioned around a peripheral area thereof. The second plate has a central hole in fluid communication with the curved pipe and a plurality of screw holes positioned around a peripheral area thereof. The first plate is coupled to a faceplate for supporting a wall mounted toilet above a floor surface, the second plate is coupled to a plumbing system and the curved pipe provides fluid communication between a waste discharge conduit and the plumbing system.

13 Claims, 5 Drawing Sheets

(56) References Cited

U.S. PATENT DOCUMENTS

| | | | | |
|---|---|---|---|---|
| D475,778 | S * | 6/2003 | Stout, Jr. | D23/393 |
| D475,779 | S | 6/2003 | Stout, Jr. | |
| 6,979,027 | B2 | 12/2005 | Hetzler et al. | |
| 7,188,376 | B2 | 3/2007 | Ortiz et al. | |
| 2004/0163165 | A1 | 8/2004 | Ortiz et al. | |
| 2005/0251903 | A1 | 11/2005 | Ortiz et al. | |
| 2005/0278841 | A1 | 12/2005 | Coronado et al. | |
| 2006/0101562 | A1 | 5/2006 | Folsom | |

* cited by examiner

OFF-SET CARRIER

CROSS REFERENCE TO RELATED APPLICATIONS

This application claims the benefit of U.S. Provisional Patent Application No. 61/042,092, entitled "Off-set Carrier", filed Apr. 3, 2008, which is hereby incorporated by reference in its entirety.

BACKGROUND OF THE INVENTION

1. Field of the Invention

The present invention relates generally to a system for supporting wall mounted toilets or water closets and, more specifically, to an off-set pipe coupling designed for use with a carrier plate used to support a wall mounted toilet or water closet.

2. Description of Related Art

Wall mounted toilets or water closets are known in the art. In order to mount a toilet to the wall, and in order to support the weight of a user on said toilet, it is common to provide a suitable support system, that includes a carrier faceplate, disposed behind the wall for supporting both the toilet and related plumbing. One example of a carrier faceplate is disclosed in co-pending U.S. patent application Ser. No. 11/949,246, which is hereby incorporated by reference in its entirety.

With reference to FIGS. 1 and 2, the carrier faceplate 1 disclosed in co-pending U.S. patent application Ser. No. 11/949,246 includes a body 3 having a first, front surface 5 and a second, rear surface 7 on the back side thereof. Body 3 of carrier faceplate 1 also has a third, bottom supporting surface 9 and a fourth, top surface 11. Third, bottom supporting surface 9 of carrier faceplate 1 extends outwardly from second, rear surface 7 forming at least one ledge-like support member 13. Each support member 13 is given structural support via at least one flange 15 that extends outwardly from, and along the length of, second, rear surface 7 meeting support member 13. Further, body 3 of carrier faceplate 1 defines a receiving hole 17 that is centrally located or substantially centrally located about carrier faceplate 1 that extends through first, front surface 5 and second, rear surface 7. A collar 19 surrounds the periphery of receiving hole 17 and collar 19 extends outwardly from first, front surface 5. Receiving hole 17 is adapted to receive a waste discharge conduit 21 that is in fluid communication with a plumbing system 23 upon threadable engagement with collar 19. Discharge conduit 21 and plumbing system 23 are utilized in prior art systems, such as the Zurn® Z-1203-H carrier.

Body 3 of carrier faceplate 1 also defines a plurality of elongated through slots 25 that receive screws 27 or other fastening means to fixedly connect carrier faceplate 1 to plumbing system 23. Additionally, body 3 of carrier faceplate 1 also has a plurality of mounting holes that receive screws 29 or other fastening means passing through a wall 31 to fixedly connect the carrier faceplate 1 to a toilet (not shown). Once assembled, the carrier faceplate 1 is able to support the weight of a wall mounted toilet (not shown) or water closet located on the opposite side of wall 31 or other support structures. Further, waste discharge conduit 21 is received by receiving hole 17 of collar 19 and is coupled to plumbing system 23.

In order to install carrier faceplate 1, receiving hole 17 of carrier faceplate 1 must be in proper alignment with waste discharge conduit 21 so that the wall mounted toilet is at the proper orientation. However, this installation is oftentimes difficult and cumbersome to perform due to the close proximity of plumbing system 23 to body 3 of carrier faceplate 1.

This makes it difficult for the installer to tighten screws 27 to secure body 3 to plumbing system 23.

Accordingly, a need exists for a pipe coupling configured to be positioned between body 3 of carrier faceplate 1 and plumbing system 23 that allows carrier faceplate 1 to be off-set from plumbing system 23, thereby allowing presently installed wall mounted toilets to be moved further from the bathroom stall wall during retrofit applications to meet Americans with Disabilities Act (ADA) standards.

SUMMARY OF THE INVENTION

The present invention provides an off-set coupling that allows presently installed wall mounted toilets to be moved further from the bathroom stall wall during retrofit applications to meet ADA standards. The off-set pipe coupling also provides an installer with easier access to the screws used to couple the carrier faceplate to a plumbing system.

More specifically, the present invention is directed to an off-set pipe coupling for use in a support system for a wall mounted toilet or water closet. The off-set pipe coupling includes a curved pipe having a first end and a second end; a first plate coupled to the first end of the curved pipe; and a second plate coupled to the second end of the curved-pipe. The first plate has a central hole in fluid communication with the curved pipe and a plurality of screw holes positioned around a peripheral area thereof. The second plate has a central hole in fluid communication with the curved pipe and a plurality of screw holes positioned around a peripheral area thereof. The first plate is coupled to a faceplate for supporting a wall mounted toilet above a floor surface, the second plate is coupled to a plumbing system and the curved pipe provides fluid communication between a waste discharge conduit and the plumbing system.

The off-set pipe coupling may be configured to shift a centerline of the faceplate in a horizontal direction relative to the plumbing system. The faceplate may include a faceplate body defining a receiving hole extending therethrough configured to receive a waste discharge conduit, and a support member extending from at least one surface of the faceplate body configured to contact the floor surface, thereby adapted to support the wall mounted toilet. The central hole of the first plate may be positioned in fluid communication with the receiving hole of the faceplate body. The faceplate body may further define a plurality of elongated through slots adapted to receive screws to fixedly connect the faceplate body to the plurality of screw holes of the first plate of the off-set pipe coupling. The plumbing system may include a plurality of screw holes adapted to receive screws to fixedly connect the plumbing system to the plurality of screw holes of the second plate of the off-set pipe coupling.

The off-set pipe coupling may be manufactured from either cast iron or polymeric materials. In addition, the curved pipe, the first plate and the second plate may be manufactured either integrally or as separate components that are thereafter welded together. The curved pipe of the off-set pipe coupling may be configured to conform with and provide a sanitary sweep flow path.

The present invention is also directed to a support system for a wall mounted toilet. The support system includes a faceplate, an off-set pipe coupling and a plumbing system. The faceplate includes a faceplate body defining a receiving hole extending therethrough configured to receive a waste discharge conduit and a support member extending from at least one surface of the faceplate body configured to contact a floor surface, thereby adapted to support the wall mounted toilet. The off-set pipe coupling includes a curved pipe having a first end and a second end; a first plate coupled to the first end of the curved pipe; and a second plate coupled to the second end of the curved pipe. The first plate has a central hole in fluid communication with the curved pipe and a plurality of screw holes positioned around a peripheral area thereof. The first plate is coupled to the faceplate such that the central hole thereof is positioned in fluid communication with the receiving hole of the faceplate body. The second plate has a central hole in fluid communication with the curved pipe and a plurality of screw holes positioned around a peripheral area thereof. The plumbing system is coupled to the second plate of the off-set pipe coupling. The waste discharge conduit is in fluid communication with the plumbing system via the curved pipe of the off-set pipe coupling.

The off-set pipe coupling may be configured to shift a centerline of the faceplate in a horizontal direction relative to the plumbing system. The faceplate body may further define a plurality of elongated through slots adapted to receive screws to fixedly connect the faceplate body to the plurality of screw holes of the first plate of the off-set pipe coupling. The plumbing system may include a plurality of screw holes adapted to receive screws to fixedly connect the plumbing system to the plurality of screw holes of the second plate of the off-set pipe coupling.

The off-set pipe coupling may be manufactured from either cast iron or polymeric materials. In addition, the curved pipe, the first plate and the second plate of the off-set pipe coupling may be manufactured either integrally or as separate components that are thereafter welded together.

The present invention is also a method for supporting a wall mounted toilet above a floor surface. The method includes the steps of providing a support system for a wall mounted toilet. The support system includes a faceplate, an off-set pipe coupling and a plumbing system. The off-set pipe coupling includes a curved pipe having a first end and a second end; a first plate coupled to the first end of the curved pipe; and a second plate coupled to the second end of the curved pipe. The first plate has a central hole in fluid communication with the curved pipe and a plurality of screw holes positioned around a peripheral area thereof. The second plate has a central hole in fluid communication with the curved pipe and a plurality of screw holes positioned around a peripheral area thereof. The method further includes the steps of coupling the first plate of the off-set pipe coupling to the faceplate such that the central hole thereof is positioned in fluid communication with a receiving hole of a body of the face plate and coupling the second plate to the plumbing system. The curved pipe of the off-set pipe coupling provides fluid communication between a waste discharge conduit and the plumbing system.

The off-set pipe coupling may be configured to shift a centerline of the faceplate in a horizontal direction relative to the plumbing system. The faceplate may include the body which defines a receiving hole extending therethrough configured to receive the waste discharge conduit and a support member extending from at least one surface of the body configured to contact the floor surface, thereby adapted to support the wall mounted toilet. The body of the faceplate may further define a plurality of elongated through slots adapted to receive screws to fixedly connect the faceplate body to the plurality of screw holes of the first plate of the off-set pipe coupling. The plumbing system may include a plurality of screw holes adapted to receive screws to fixedly connect the plumbing system to the plurality of screw holes of the second plate of the off-set pipe coupling. The off-set pipe coupling may be manufactured from either cast iron or polymeric materials.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. As used in the specification and the claims, the singular form of "a", "an" and "the" include plural referents unless the context clearly dictates otherwise.

DETAILED DESCRIPTION OF THE PRESENT INVENTION

Figure 1:
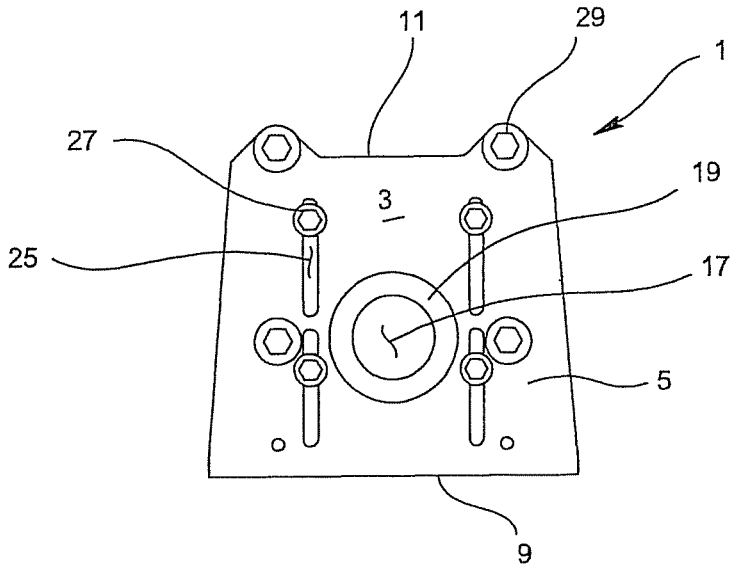
FIG. 1 (Prior Art)
FIG. 1 is a front plan view of a conventional one-piece carrier faceplate and associated hardware.
Figure 2:
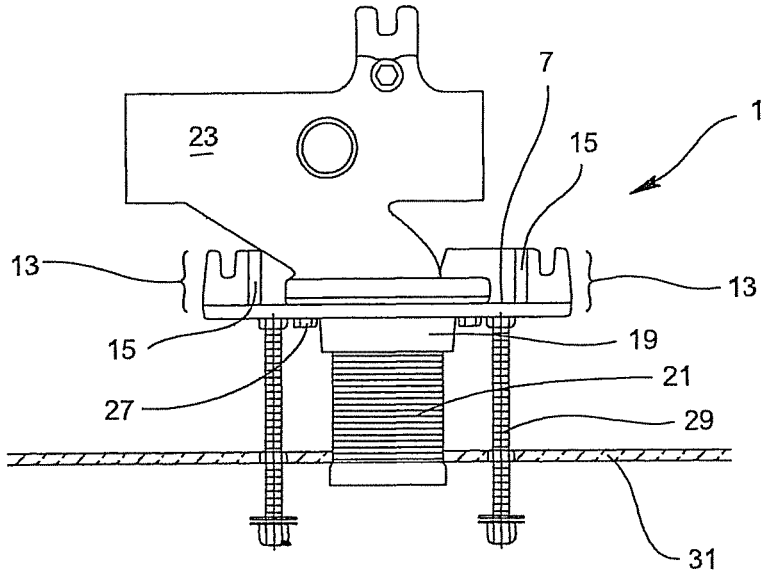
FIG. 2 (Prior Art)
FIG. 2 is a top plan view of the conventional one-piece carrier faceplate and associated hardware of FIG. 1 shown mounted to a wall and coupled to a waste discharge conduit.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations, except where expressly specified to the contrary. It is also to be understood that the specific devices illustrated in the attached drawings, and described in the following specification, are simply exemplary embodiments of the invention. Hence, specific dimensions and other physical characteristics related to the embodiments disclosed herein are not to be considered as limiting.

Figure 3:
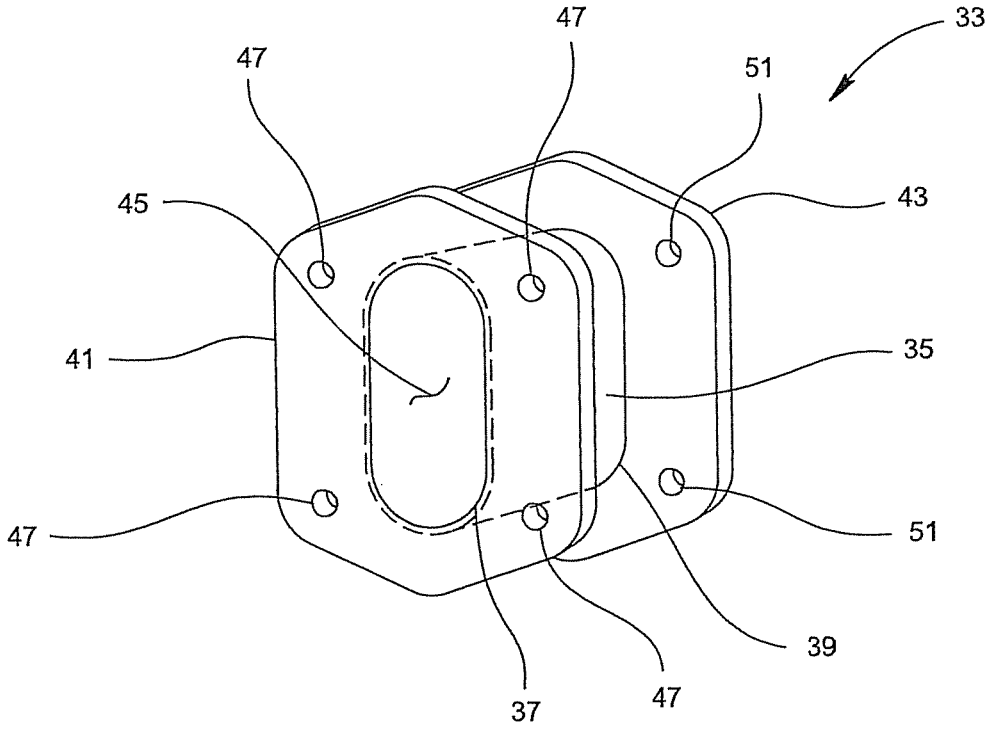
FIG. 3 is a perspective view of an off-set pipe coupling in accordance with the present invention.
Figure 4:
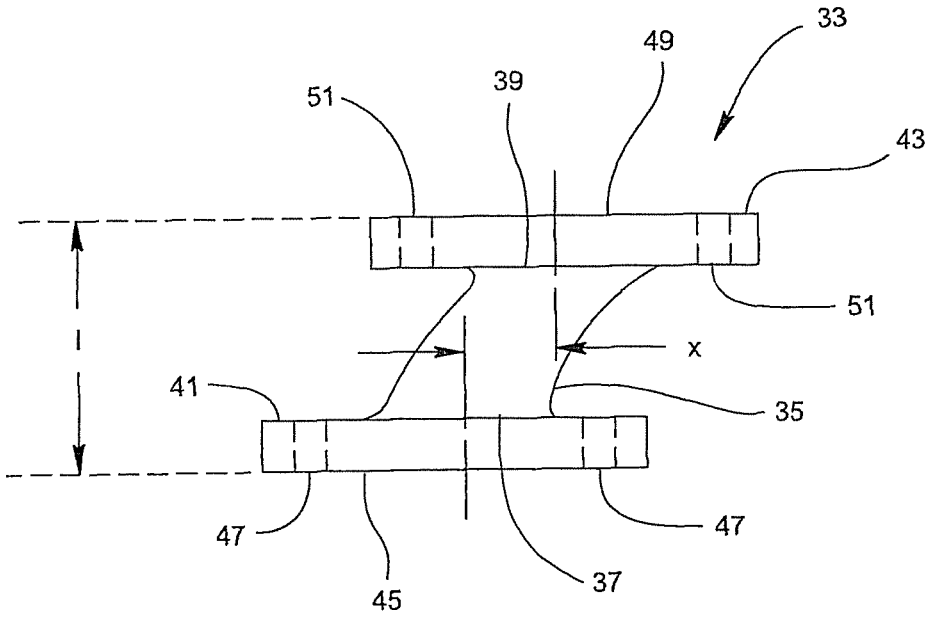
FIG. 4 is a top plan view of the off-set pipe coupling of FIG. 3 in accordance with the present invention.

With reference to FIGS. 3 and 4, an off-set pipe coupling, denoted generally as reference numeral 33, includes a curved pipe 35 having a first end 37 and a second end 39, a first plate 41 coupled to first end 37 of curved pipe 35 and a second plate 43 coupled to second end 39 of curved pipe 35. First plate 41 has a central hole 45 in fluid communication with curved pipe 35 and a plurality of screw holes 47 positioned around a peripheral area thereof. Second plate 43 has a central hole 49 in fluid communication with curved pipe 35 and a plurality of screw holes 51 positioned around a peripheral area thereof.

Off-set pipe coupling 33 is configured to have an off-set x of about 1.5 inches to about 2 inches. The off-set x of off-set pipe coupling 33 is provided to shift a centerline of carrier faceplate 1 in a horizontal or lateral direction relative to plumbing system 23 as will be discussed in greater detail hereinafter. Alternatively, it is contemplated to provide an off-set in other directions, such as vertical or an angled direction. Additionally, off-set pipe coupling 33 has a length l that is kept to a minimum based on the fastening means used to couple off-set pipe coupling 33 to carrier faceplate 1 and plumbing system 23. Curved pipe 35, first plate 41 and second plate 43 of off-set pipe coupling 33 may be manufactured integrally or as separate components that are welded together. Additionally, off-set pipe coupling 33 may be manufactured from cast iron or polymeric materials, such as PVC, or any other suitable materials.

Figure 5:
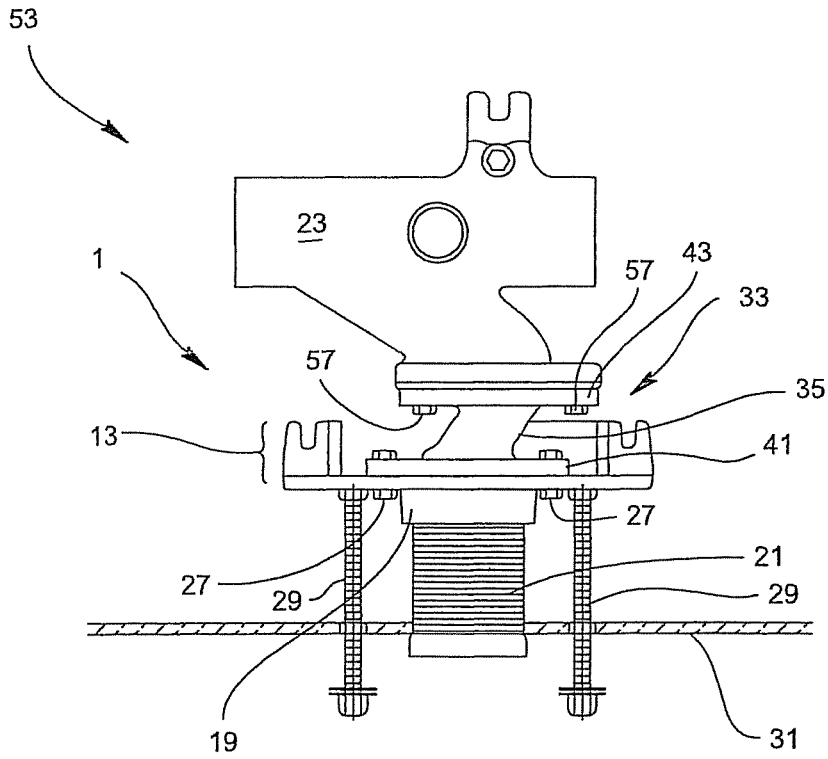
FIG. 5 is a top plan view of the off-set pipe coupling of FIGS. 3 and 4 used with the carrier faceplate and associated hardware of FIG. 1, shown mounted to a wall and coupled to a waste discharge conduit.
Figure 6:
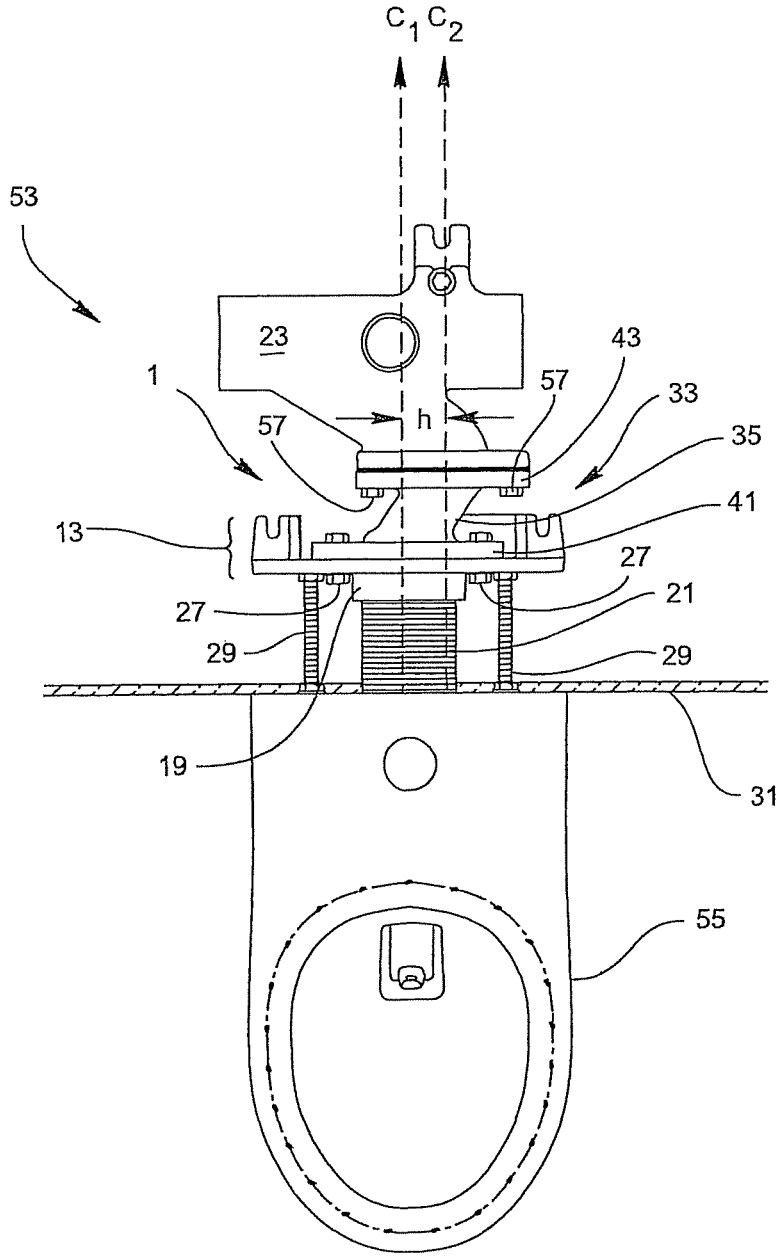
FIG. 6 is a top plan view of the off-set pipe coupling of FIGS. 3 and 4 used with the carrier faceplate and associated hardware of FIG. 1, shown supporting a wall mounted toilet and coupled to a waste discharge conduit.

With reference to FIGS. 5 and 6, and with continuing reference to FIGS. 3 and 4, off-set pipe coupling 33 is configured to be used as part of a support system, denoted generally as reference numeral 53, that also includes a carrier faceplate 1, such as the carrier faceplate discussed hereinabove and disclosed in U.S. patent application Ser. No. 11/949,246, and a plumbing system 23. As discussed hereinabove, carrier faceplate 1 includes a body 3 defining a receiving hole 17 extending therethrough configured to receive a waste discharge conduit 21 and a support member 13 extending from body 3 and configured to contact a floor surface, thereby supporting a wall mounted toilet 55.

Body 3 of carrier faceplate 1 includes a plurality of elongated through slots 25 as discussed hereinabove. Elongated through slots 25 are configured to receive screws 27 or other suitable fastening means to fixedly connect carrier faceplate 1 to first plate 41 of off-set pipe coupling 33 via screw holes 47. Plumbing system 23 may include a plurality of screw holes (not shown) adapted to receive screws 57 or other suitable fastening means to fixedly connect plumbing system 23 to the plurality of screw holes 51 of second plate 43 of off-set pipe coupling 33. Additionally, body 3 of carrier faceplate 1 also has a plurality of mounting holes that receive screws 29 or other fastening means passing through a wall 31 to fixedly connect carrier faceplate 1 to a toilet 55.

Carrier faceplate 1 must be configured to direct flow in a certain direction from water discharge conduit 21 to plumbing system 23 in a particular direction, such as right to left, thereby providing a required sanitary sweep flow path. Typically, this sanitary sweep flow path was provided by using two 90° elbow-type coupling members. Off-set pipe coupling 33 of the present invention, however, eliminates the need for the use of two 90° elbow-type coupling members. Curved pipe 35 of off-set pipe coupling 33 conforms with and provides the required sanitary sweep flow path.

Once assembled, the support system 53 is able to support the weight of a wall mounted toilet 55 or water closet located on the opposite side of wall 31 or other support structure. Further, first plate 41 is coupled to carrier faceplate 1, second plate 43 is coupled to plumbing system 23, and curved pipe 35 provides fluid communication between waste discharge conduit 21 and plumbing system 23.

During installation, an installer has much easier access to screws 27 due to the off-set nature of off-set pipe coupling 33 than in the system disclosed in co-pending U.S. patent application Ser. No. 11/949,246 discussed hereinabove. More specifically, an installer gains better access to screws 27 and screws 57 because a centerline $C_1$ of carrier faceplate 1 is shifted in a horizontal direction by a distance h relative to plumbing system 23 to a centerline $C_2$. The distance h is equal to the off-set x of off-set pipe coupling 33.

Although the invention has been described in detail for the purpose of illustration based on what is currently considered to be the most practical embodiments, it is to be understood that such detail is solely for that purpose and that the invention is not limited to the disclosed embodiments, but, on the contrary, is intended to cover modifications and equivalent arrangements. For example, it is to be understood that the present invention contemplates that, to the extent possible, one or more features of any embodiment can be combined with one or more features of any other embodiment.

The invention claimed is:

1. A method for supporting a wall mounted toilet above a floor surface comprising the steps of:

a) providing a support system for a wall mounted toilet comprising:

i) a waste discharge conduit;

ii) a faceplate, the faceplate comprising:

a body which defines a circular receiving hole extending therethrough, the circular receiving hole receiving the waste discharge conduit; and a support member extending from at least one surface of the body configured to contact the floor surface, thereby adapted to support the wall mounted toilet;

iii) an off-set pipe coupling comprising:

a curved pipe having a first end and a second end, the curved pipe being curved less than 90° at both the first end and the second end;

a first plate coupled to and surrounding the first end of the curved pipe at a furthest extent of the curved pipe, the first plate having an oblong circular central hole in fluid communication with the curved pipe and a plurality of screw holes positioned around a peripheral area thereof; and a second plate coupled to the second end of the curved pipe, the second plate having a central hole in fluid communication with the curved pipe and a plurality of screw holes positioned around a peripheral area thereof; and iv) a plumbing system;

b) coupling the first plate of the off-set pipe coupling to the faceplate such that the central hole thereof is positioned in fluid communication with the round receiving hole of the body of the faceplate and the waste discharge conduit; and c) coupling the second plate to the plumbing system, wherein the curved pipe of the off-set coupling provides fluid communication between the waste discharge conduit and the plumbing system.

2. The method of claim 1, wherein the off-set pipe coupling shifts a centerline of the faceplate in a lateral direction relative to the plumbing system.

3. The method of claim 1, wherein the body further defines a plurality of elongated through slots adapted to receive screws to fixedly connect the faceplate body to the plurality of screw holes of the first plate of the off-set pipe coupling.

4. The method of claim 1, wherein the plumbing system includes a plurality of screw holes adapted to receive screws to fixedly connect the plumbing system to the plurality of screw holes of the second plate of the off-set pipe coupling.

5. The method of claim 1, wherein the central hole of the first plate overlaps with the central hole of the second plate in a horizontal direction of the off-set pipe coupling.

6. A support system for a wall mounted toilet comprising:

a waste discharge conduit;

a faceplate comprising:

a faceplate body defining a circular receiving hole extending therethrough, the circular receiving hole receiving the waste discharge conduit; and a support member extending from at least one surface of the faceplate body configured to contact a floor surface, thereby adapted to support the wall mounted toilet;

an off-set pipe coupling comprising:

a curved pipe having a first end and a second end, the curved pipe being curved less than 90° at both the first end and the second end;

a first plate coupled to and surrounding the first end of the curved pipe at a furthest extent of the curved pipe, the first plate having an oblong circular central hole in fluid communication with the curved pipe and a plurality of screw holes positioned around a peripheral area thereof, the first plate coupled to the faceplate such that the central hole thereof is positioned in fluid communication with the round receiving hole of the faceplate body and the discharge conduit; and a second plate coupled to the second end of the curved pipe, the second plate having a central hole in fluid communication with the curved pipe and a plurality of screw holes positioned around a peripheral area thereof; and a plumbing system coupled to the second plate of the off-set pipe coupling, wherein the waste discharge conduit is in fluid communication with the plumbing system via the curved pipe of the off-set pipe coupling.

7. The support system of claim 6, wherein the off-set pipe coupling shifts a centerline of the faceplate in a horizontal direction relative to the plumbing system.

8. The support system of claim 6, wherein the faceplate body further defines a plurality of elongated through slots adapted to receive screws to fixedly connect the faceplate body to the plurality of screw holes of the first plate of the off-set pipe coupling.

9. The support system of claim 6, wherein the plumbing system includes a plurality of screw holes adapted to receive screws to fixedly connect the plumbing system to the plurality of screw holes of the second plate of the off-set pipe coupling.

10. The support system of claim 6, wherein the off-set pipe coupling is manufactured from one of cast iron or polymeric materials.

11. The support system of claim 6, wherein the curved pipe, the first plate and the second plate of the off-set pipe coupling are manufactured integrally.

12. The support system of claim 6, wherein the curved pipe, the first plate and the second plate of the off-set pipe coupling are manufactured as separate components that are thereafter welded together.

13. The support system of claim 6, wherein the central hole of the first plate overlaps with the central hole of the second plate in a horizontal direction of the off-set pipe coupling.

* * * * *